US008464614B2

(12) United States Patent
Suzuki

(10) Patent No.: US 8,464,614 B2
(45) Date of Patent: Jun. 18, 2013

(54) RATCHET WRENCH HANDLE

(75) Inventor: Shoji Suzuki, Kakegawa (JP)

(73) Assignee: Ko-Ken Tool Co., Ltd., Kakegawa, Shizuoka-Pref. (JP)

( * ) Notice: Subject to any disclaimer, the term of this patent is extended or adjusted under 35 U.S.C. 154(b) by 350 days.

(21) Appl. No.: 12/805,600

(22) Filed: Aug. 9, 2010

(65) Prior Publication Data

US 2011/0067531 A1 Mar. 24, 2011

(30) Foreign Application Priority Data

Sep. 18, 2009 (JP) ..... 2009-217207
Sep. 30, 2009 (JP) ..... 2009-227155

(51) Int. Cl.
*B25B 13/46* (2006.01)

(52) U.S. Cl.
USPC ..... 81/63

(58) Field of Classification Search
USPC ..... 80/60–63.2; 81/60–63.2
See application file for complete search history.

(56) References Cited

U.S. PATENT DOCUMENTS 655,908 A * 8/1900 Morse ..... 81/63
979,862 A * 12/1910 Lane ..... 81/63
5,584,220 A * 12/1996 Darrah et al. ..... 81/63

FOREIGN PATENT DOCUMENTS

JP 2004-345011 12/2004
JP 2005-297123 10/2005

* cited by examiner

*Primary Examiner* — Hadi Shakeri
(74) *Attorney, Agent, or Firm* — Jacobson Holman PLLC

(57) ABSTRACT

In a ratchet wrench handle, an operation piece is swingably supported by an axis in a handle head. Positive and reverse rotation claws are disposed on one and the other portions of a distal end surface of an operation piece. The operation piece is provided with a cam edge at its backward end surface. A pressing pin is provided in a switch member such that the pressing pin can freely move into and out of the switch member. The distal end of the pressing pin pressurely contacts with the cam edge through a force of a spring. The switch member is located on a line extended from an imaginary straight line running between the rotation axis of the rotation member and the axis of the operation piece.

2 Claims, 3 Drawing Sheets

RATCHET WRENCH HANDLE

TECHNICAL FIELD OF THE INVENTION

The present invention relates to a ratchet wrench handle for fastening and loosening a bolt in such a manner that an adaptor (a socket) is engaged with and assembled to a rotation member provided at the handle head, and then is engaged with a head of the bolt.

BACKGROUND OF THE INVENTION

There have been known ratchet wrench handles (such as prior art documents 1 and 2 as listed below), wherein a rotation member, which has an adaptor-connecting portion such as a square shaft, a non-round recess or the like for engagement with an adaptor (a socket), is mounted at a handle head located at a distal end of an operation handle; said adaptor is rotatable in either a positive or reverse rotational direction by engaging a claw selected from a pair of positive and reverse rotation-aimed engaging claws, with ratchet teeth that are continuously provided on a periphery of said rotation member; and the switching operation between the positive and reverse rotations is performed by a switch lever which has the above-mentioned pair of engaging claws and is swingably axially supported in said handle head (as shown, for example, by the under-listed reference materials).

PRIOR ART DOCUMENTS

Reference material 1;
Japanese Patent Application Laid-Open No. 2004-345011
Reference Material 2;
Japanese Patent Application Laid-Open No. 2005-297123

SUMMARY OF THE INVENTION

Problems to be Solved by the Present Invention

According to said conventional techniques, only a single member plays two roles; one is a role of forming a pair of positive and reverse rotation-aimed engaging claws to engage with ratchet teeth, and the other is a role as a switch member for selecting a claw from the above-mentioned pair of positive and reverse rotation-aimed engaging claws to engage with the ratchet teeth. Besides that, said single member is supported by a single axis. Thus, said single member directly suffers oscillation of its engaging claws that is caused by and comes from the ratchet teeth while the rotation member is idling, which is characteristic of ratchet wrench handles at the time of fastening and loosening operations. Because of the oscillation of the engaging claws, said single member designed to have two functions of engaging claws and a switch member, may swing about its axis, and the engaging claws may engage with the ratchet teeth in the opposite manner such that the positive rotation-aimed claws engage with the reverse rotation ratchet teeth, and vice versa. In this way, unintended switch operation tends to be caused by the conventional techniques.

Therefore, in the conventional art, it would be necessary to enhance considerably the flexibility of a coil spring to press a ball that maintains the engaging claws in the positive or reverse direction. However, any attempt to enhance such flexibility is limited within only a small range owing to the limited size of a ratchet wrench handle.

The present invention has been made in order to eliminate the problems seen in such conventional art, and has an object of providing a ratchet wrench handle which does not cause any unintended switch operation through an opposite engagement such as engagement between one or more positive rotation-aimed claws and the reverse rotation-aimed ratchet teeth and vice versa at the time of idling of the rotation member. Another object of the present invention is to provide a ratchet wrench handle whose handle head is structurally smaller than those of the conventional ratchet wrench handles, but it can still produce the same torque as the conventional ones without deterioration of performance.

Means for Solving the Problems

A ratchet wrench handle according to the present invention basically comprises a rotation member provided at a handle head located at a distal end of an operation handle, said rotation member being provided with a portion for connecting an adaptor and being provided with ratchet teeth continuously formed on a periphery of said rotation member; wherein either one side chosen between one or more positive rotation-aimed operation claws and one or more reverse rotation-aimed operation claws can be engaged with said ratchet teeth through operating a switch member so that said adaptor is rotated in a positive or reverse rotational direction; characterized in that an operation piece is swingably supported by an axis in said handle head; said one or more positive rotation-aimed operation claws are disposed on one portion of a distal end surface of said operation piece that faces said rotation member, and said one or more reverse rotation-aimed operation claws are disposed on the oppositely located other portion of said distal end surface; said operation piece is provided, at a middle portion of its backward end surface that is located oppositely to a middle portion between said positive and reverse rotation-aimed operation claws on said distal end surface, with a cam edge recessed like an arc in the direction of said distal end surface; a pressing pin is provided in said switch member in such a manner that said pressing pin can freely move into and out of said switch member; a distal end of said pressing pin pressurely contacts with said cam edge by way of a biasing force of a spring; and said switch member is located on a line extended from an imaginary straight line running between the rotation axis of said rotation member and the aforesaid axis. An additional aspect of the ratchet wrench handle according to the present invention is that a set of plural positive rotation-aimed operation claws and a set of plural reverse rotation-aimed operation claws are provided symmetrically on a distal end surface of the operation piece in such a manner that each set of the positive and reverse rotation-aimed operation claws is positioned such as to be concentric with said ratchet teeth when engaging with said ratchet teeth; and said operation piece is provided, on each of the two lateral sides thereof, with a contact edge which is, when said operation piece receives a load from said ratchet teeth, to pressurely contact with one of pressure receiving edges provided on an inner edge of an accommodation chamber that accommodates said operation piece. Therefore, at the time of positive rotation of the rotation member (for example, at the time of fastening a bolt), plural positive rotation-aimed operation claws are engaged with the ratchet teeth; and at the time of reverse rotation of the rotation member (for example, at the time of loosening a bolt), plural reverse rotation-aimed operation claws are engaged with the ratchet teeth. Besides that, the rotation member can be torqued by plural operation claws, while engagement between the ratchet teeth and the operation claws is maintained by an engagement relationship between a contact edge from the operation piece side and a pressure receiving edge from the handle head side. In this way, a ratchet wrench handle which can be used in an ideal manner can be provided. Furthermore, the torque, which is applied by plural operation claws, disperses according to the number of operation claws. This enables the ratchet teeth to be smaller, which means that the diameter of the rotation member can also be made smaller, and thus the handle head which accommodates said rotation member can also be made smaller. In this way, a ratchet wrench handle with a smaller handle head can be provided.

Effect of the Invention

When the ratchet teeth of the rotation member idle without engagement with the operation claws, the ratchet teeth push the operation claws, thereby causing the operation piece with said operation claws to swing about its axis. In that case, however, the present invention can avoid any unintended switch operation caused by an opposite engagement such as engagement between one or more positive rotation-aimed operation claws and the reverse rotation-aimed ratchet teeth or vice versa, because the swinging movement of the switch member is restricted in such a manner that said operation piece is pressed by a pressing pin which is combined with the switch member rotatable about a rotation axis other than the aforesaid axis, and the pressing pin is biased by a coil spring.

PREFERRED EMBODIMENT

Figure 1:
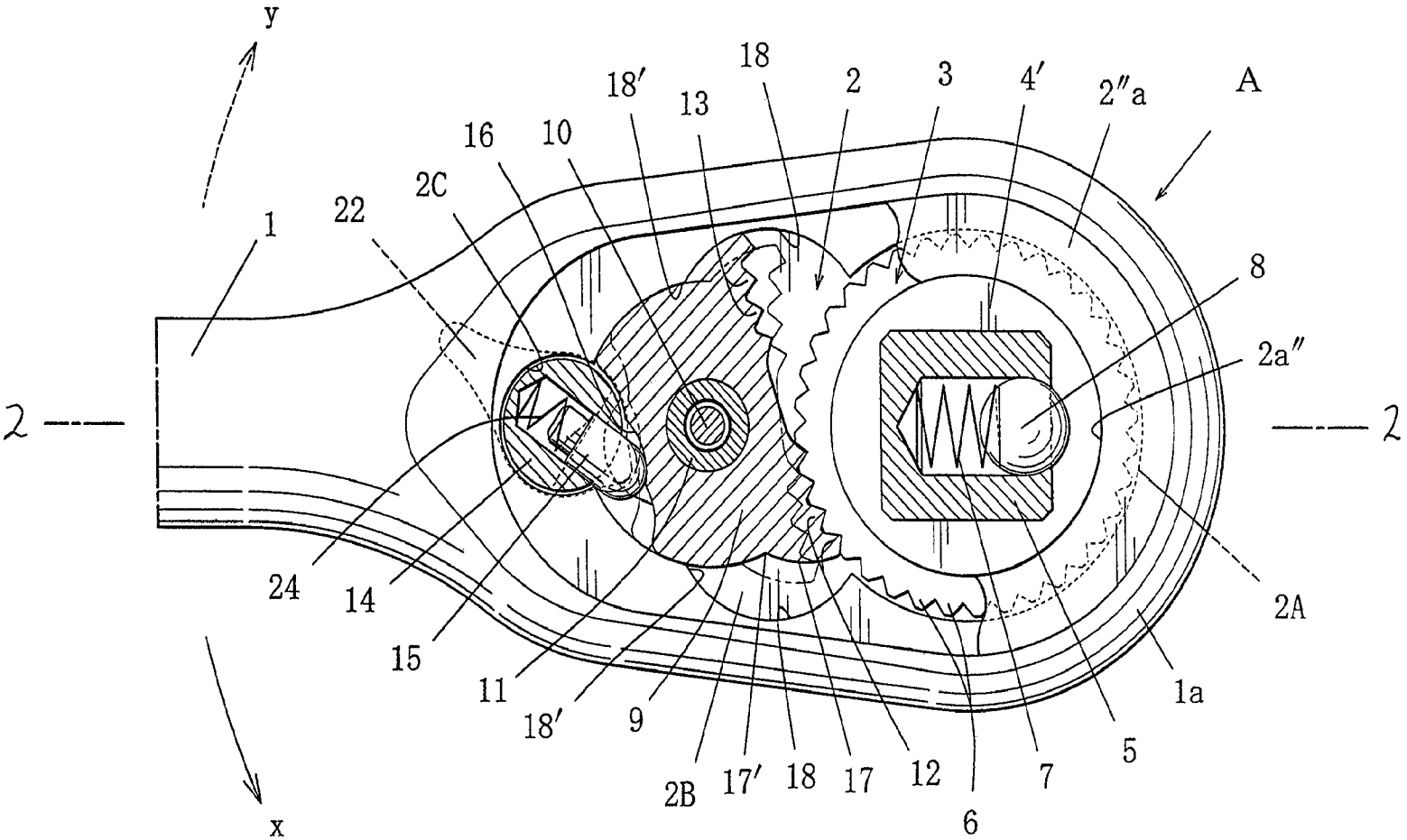
FIG. 1 shows a front view of a ratchet wrench handle according to the present invention wherein a part is omitted.
Figure 2:
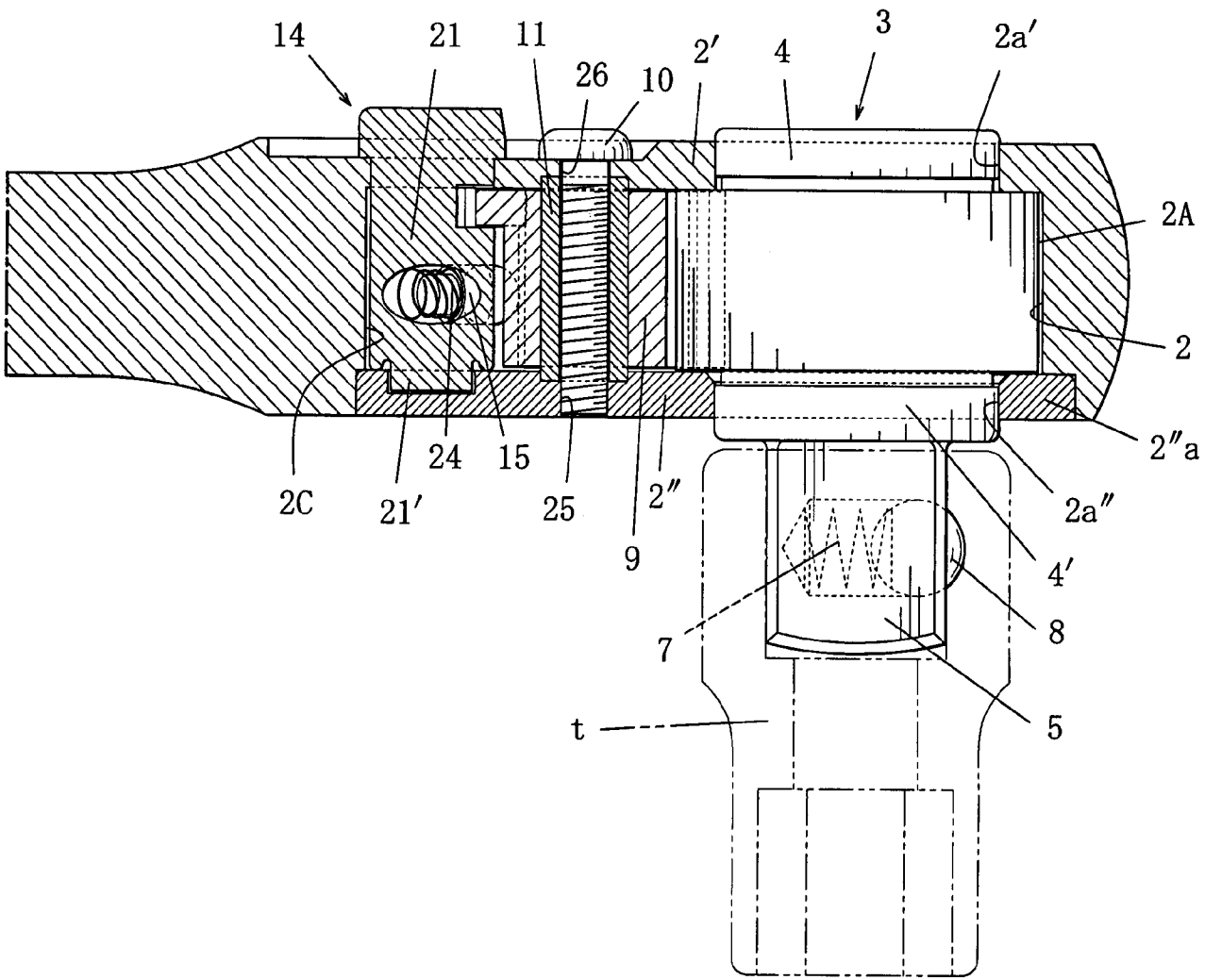
FIG. 2 shows a cross-sectional view thereof taken along line 2-2 indicated in FIG. 1.
Figure 3:
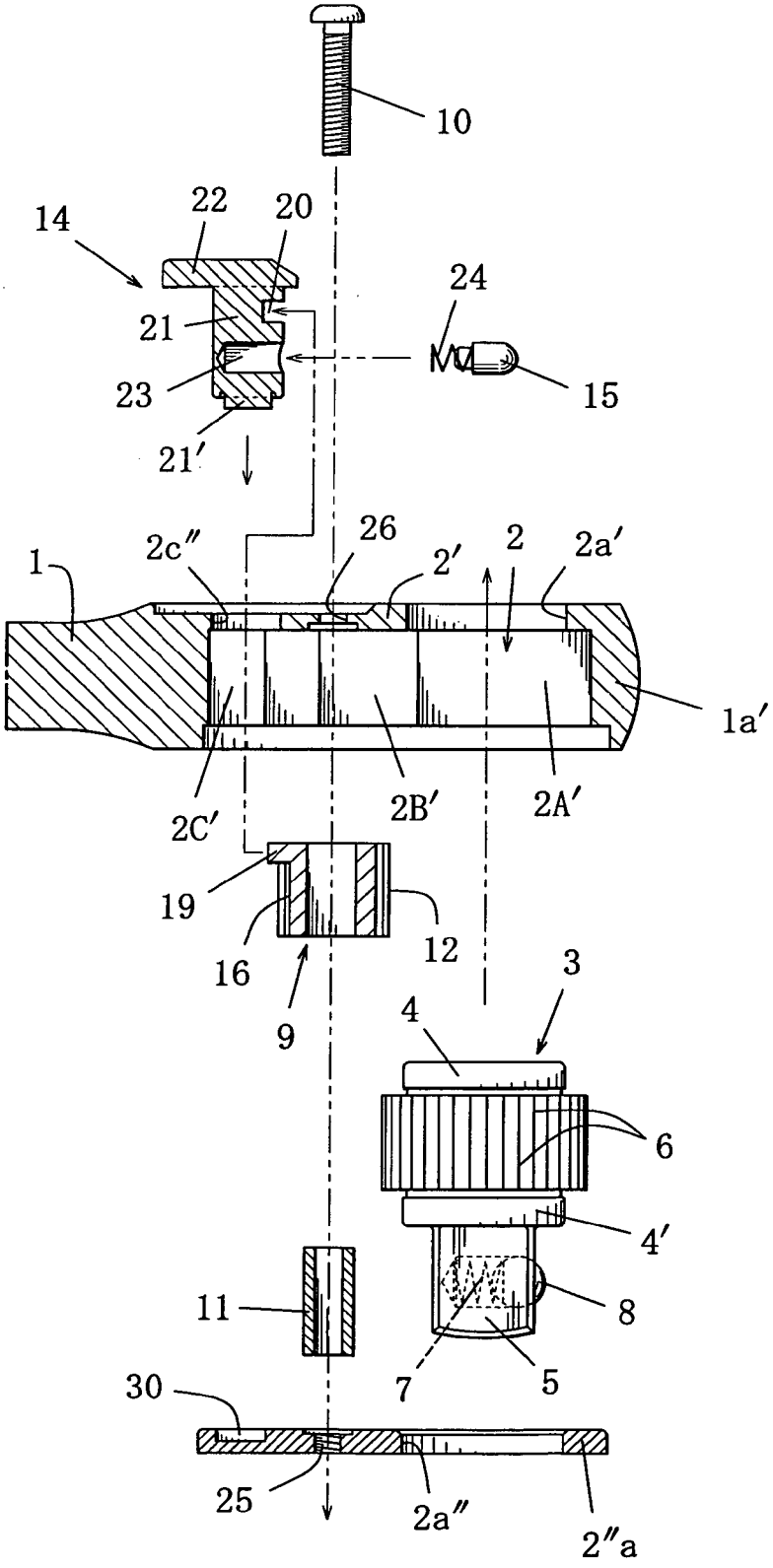
FIG. 3 shows a cross-sectional view thereof wherein the ratchet wrench handle has been disassembled into pieces.

In a preferred embodiment of the present invention, a ratchet wrench handle A is constructed as follows: a handle head 1*a* (which is, as stated below, formed by assembling a handle head frame 1*a*' and a lid plate 2"*a* by means of an assembling bolt 10) is provided at a distal end of an operation handle 1; an accommodation chamber 2 is provided in said handle head 1*a*, and is made up of a first accommodation portion 2A having a round shape as seen from the top or bottom side of the head 1*a*, a second accommodation portion 2B having a figure-"8" shape in outline as seen from the top or bottom side of the head 1*a*, and a third accommodation portion 2C having a small round shape as seen from the top or bottom side of the head 1*a*, such that said accommodation portions are arranged in alphabetical order from the distal end of the head 1*a* toward the backward end of the head 1*a*, in partially overlapping manner; through openings 2*a*', 2*a*" are bored in the top and bottom surface portions of the head 1*a* such that said first accommodation portion 2A of said accommodation chamber 2 is connected with its outside; and a rotation member 3 is rotatably supported by said first accommodation portion 2A of said accommodation chamber 2.

The rotation member 3 is provided on its periphery with continuous ratchet teeth 6, and is provided on both of the top and bottom surface portions thereof with step portions 4, 4' each having a round shape as seen in its frontal view such that the step portions 4, 4' are designed for use as a rotation axis of the rotation member 3. On an axis of one of the step portions 4, 4' projectingly provided is a square shaft 5 on which an adapter t is to be mounted. The step portions 4, 4' are engaged with through openings 2*a*', 2*a*", while said ratchet teeth 6 are accommodated in said first accommodation portion 2A. In this way, the step portions 4, 4' are designed to function as a rotation axis as mentioned above, and the rotation member 3 is rotatably supported by the first accommodation portion 2A which forms a part of the accommodation chamber 2 of the handle head 1*a*.

In this respect, a square shaft 5 is provided therein with a ball 8 biased in the projecting direction by a coil spring 7, such that said ball 8 helps to detachably mount an adapter t on the square shaft 5 (as publicly known).

The second accommodation portion 2B, which connects with said first accommodation portion 2A as a part of said accommodation chamber 2, accommodates an operation piece 9. The operation piece 9 is swingably axially supported by an assembling bolt 10 (as a swinging axis) that fastens the lid plate 2"*a* which forms the bottom wall 2" of the accommodation chamber 2, to the top wall 2' of the accommodation chamber 2.

In this respect, reference numeral 11 indicates a collar provided between said top and bottom walls 2', 2" in such a manner that the assembling bolt 10 penetrates the collar 11. Thanks to the existence of the collar 11, the swinging movement of the operation piece 9 pivoting on the assembling bolt 10 is performed smoothly without any trouble.

Said operation piece 9 is provided, on one part of its distal end surface that faces said rotation member 3, with plural positive rotation-aimed operation claws 12 for engaging with the ratchet teeth 6 provided on said rotation member 3 such that said positive rotation-aimed operation claws 12 are located concentric with said ratchet teeth 6; and said operation piece 9 is also provided, in the same way, on the oppositely located other part of said distal end surface that faces said rotation member 3, with plural reverse rotation-aimed operation claws 13 for engaging with the ratchet teeth 6 provided on said rotation member 3 such that said reverse rotation-aimed operation claws 13 are located concentric with said ratchet teeth 6. The set of positive rotation-aimed operation claws 12 and the set of reverse rotation-aimed operation claws 13 are located symmetrical with each other, with respect to an imaginary straight line running from said assembling bolt 10. When the positive rotation-aimed operation claws 12 engage with the ratchet teeth 6, the reverse rotation-aimed operation claws 13 disengage from the ratchet teeth 6; and when the reverse rotation-aimed operation claws 13 engage with the ratchet teeth 6, the positive rotation-aimed operation claws 12 disengage from the ratchet teeth 6. The selection of either the positive or reverse operation claws 12 or 13 against the ratchet teeth 6 is done with a switch member 14 accommodated in said small-round-shaped third accommodation portion 2C connected and adjacent to said second accommodation portion 2B that accommodates the operation piece 9. The operation piece 9 is provided, at a middle portion of its backward end surface that is located oppositely to a middle portion between said positive and reverse rotation-aimed operation claws 12, 13 on said distal end surface, with an arc-shaped cam edge 16 which a pressing pin 15 of said switch member 14 engages with or disengages from.

At the middle portion of the backward end surface of the operation piece 9, a cam edge 16 is formed in such a manner as to form an arc-shaped recess in the direction of said distal end surface of the operation piece 9.

A swinging axis of the switch member 14 is located on a line extended from an imaginary straight line running between the swinging axis (the assembling bolt 10) of the operation piece 9 and the rotation axis (the step portions 4, 4') of the rotation member 3.

On each of lateral side surfaces that are located oppositely to each other and intermediately connect to said distal and backward end surfaces of the operation piece 9, is provided a mountain-shaped recessed edge (recessed step) 17' whose one side located adjacent to the distal end surface of the operation piece 9 is formed as a contact edge 17. Pressure receiving edges 18, which each receive pressing force from the operation piece 9 while engaging with said contact edge 17, are each formed on one side of the surfaces which form a mountain-shaped projection edge 18' on each of oppositely located inner edges of said second accommodation portion 2B (inner edges of the accommodation chamber 2).

In said third accommodation portion 2C which has a small round shape as seen in its frontal view and connects to the second accommodation portion 2B, said switch member 14 is swingably accommodated while being combined with the operation piece 9 such that in an insertion hole 2C" formed by making a hole in said top wall 2', a cut-off portion 20 is engaged with a projection portion 19 provided on said operation piece 9.

The switch member 14 is provided with an operation lever 22 on one end of its cylindrical main body 21 which engages with said third accommodation portion 2C having a round shape as seen in its frontal view, such that said operation lever 22 projects in the radius direction of the main body 21. The main body portion 21 is engaged with said insertion hole 2C"; and a step portion 21', which is projectingly provided at a center of the other end located oppositely to said one end of the main body 21, is engaged with a receiving hole 30 provided at the bottom wall 2" of the accommodation chamber 2. In this way, the switch member 14 is swingable on both the main body portion 21 and the step portion 21' as said swinging axis.

On a peripheral side of the main body 21 having said cut-off portion 20 on its operation lever 22 side, is provided a supporting hole 23 with which said pressing pin 15 engages by way of a coil spring 24 such that said pressing pin 15 can move into and out of the supporting hole 23. The pressing force of the coil spring 24 forces a round distal end of said pressing pin 15 to pressurely contact with one end surface or the other of said cam edge 16 of the operation piece 9. In this way, the switching operation of the operation piece 9 is performed, and either one set of the positive rotation-aimed operation claws 12 and the reverse rotation-aimed operation claws 13 maintains their engagement with the ratchet teeth 6.

The ratchet wrench handle A according to an embodiment of the present invention is assembled by engaging the rotation member 3 with a portion 2A' corresponding to said first accommodation portion 2A provided in the handle head frame 1*a*' forming the handle head 1*a* of the operation handle 1; engaging the operation piece 9 (while being engaged with the collar 11) with a portion 2B' corresponding to said second accommodation portion 2B such that the operation piece 9 is combined with the switch member 14 through an engagement relationship between the projection portion 19 and the cut-off portion 20; engaging said switch member 14 with a portion 2C' corresponding to the third accommodation portion 2C; placing the lid plate 2"*a* oppositely from the top wall 2' such that the aforesaid three members (the rotation member 3; the operation piece 9; the switch member 14) are located between them; letting the assembling bolt 10 go through the collar 11 that is placed in a through hole 26 of the top wall 2'; and threadedly engaging the distal end of the assembling bolt 10 that projects from the collar 11, with a threaded hole 25 provided in said lid plate 2"*a*, and then fastening the two members against each other.

FIG. 1 shows a status wherein the positive rotation-aimed operation claws 12 of the operation piece 9 are engaged with the ratchet teeth 6 of the rotation member 3 by operating the switch member 14 so as to press the distal end of the pressing pin 15 in said switch member 14 against one end surface of the cam edge 16 of the operation piece 9 through utilizing the biasing force of the coil spring 24. In this status, if the adapter t fitted on the square shaft 5 is also fitted, for example, on the head of a bolt, and then the operation handle 1 is rotated about the head of the bolt in the direction of the arrow indicated by x in the drawing, the operation claws 12, which press the ratchet teeth 6, make the rotation member 3 rotate in an anticlockwise direction, thereby fastening the head of the bolt that is engaged with the adapter t fitted on the square shaft 5 of the rotation member 3. After the rotation is performed up to a certain angle, the operation handle 1 is rotated in a clockwise direction to return it to its original position in such a manner that the ratchet teeth 6 idle without engagement with the operation claws 12 owing to the ratchet structure. Subsequently, the operation handle 1 is rotated in an anticlockwise direction again so as to perform the fastening of the head of the bolt.

When the ratchet teeth 6 idle without engagement with the operation claws 12 as mentioned above, the ratchet teeth 6 push the operation claws 12, thereby causing the operation piece 9 with said operation claws 12 to swing about the assembling bolt 10 as a swinging axis. At this time, even if the reverse rotation-aimed operation claws 12, instead of the positive rotation-aimed operation claws 12, tries to engage the ratchet teeth 6, engagement never occurs between them, because the pressing pin 15, which is provided in the switch member 14 (whose rotation axis is separated from that of the assembling bolt 10) and is pushed by the coil spring 24, presses one end surface of the cum edge 16 that is linked to the positive rotation-aimed operation claws 12.

On the other hand, by operating the switch member 14, the distal end of the pressing pin 15 can be made to pressurely contact with the other end surface of the cum edge 16 such that instead of the positive rotation-aimed operation claws 12, the reverse rotation-aimed operation claws 13 engage with the ratchet teeth 6. In this state, if the operation handle 1 is rotated in the direction of y indicated by the dotted line in the drawing, the head of the bolt is loosened from its fastened state. The loosening operation of the head of the bolt is performed by repeating the rotation of the operation handle 1 in a clockwise and anti-clockwise directions.

The rotation axis of the switch member 14, the swinging axis of the operation piece 9 and the rotation axis of the rotation member 3 are all located on an axis of the operation handle 1. In actually working the present invention, the portion of the rotation member for engagement with an adapter can be provided with a non-round recess instead of a square shaft.

EXPLANATION OF REFERENCE NUMERALS

1 . . . An operation handle
1*a* . . . A handle head
3 . . . A rotation member
6 . . . Ratchet teeth
9 . . . An operation piece
12 . . . Positive rotation-aimed operation claws
13 . . . Reverse rotation-aimed operation claws
14 . . . A switch member
15 . . . A pressing pin
16 . . . A cam edge

What is claimed is:

1. A ratchet wrench handle comprising a rotation member provided at a handle head located at a distal end of an operation handle, said rotation member being provided with a portion for connecting an adaptor and being provided with ratchet teeth continuously formed on a periphery of said rotation member;

either one side chosen between one or more positive rotation-aimed operation claws and one or more reverse rotation-aimed operation claws can be engaged with said ratchet teeth through operating a switch member so that said adaptor is rotated in a positive or reverse rotational direction;

an operation piece is swingably supported by an axis in said handle head;

said one or more positive rotation-aimed operation claws being disposed on one portion of a distal end surface of said operation piece that faces said rotation member, and said one or more reverse rotation-aimed operation claws are disposed on the oppositely located other portion of said distal end surface;

said operation piece being provided, at a middle portion of its backward end surface that is located oppositely to a middle portion between said positive and reverse rotation-aimed operation claws on said distal end surface, with a cam edge recessed in the direction of said distal end surface;

a pressing pin provided in said switch member in such a manner that said pressing pin can freely move into and out of said switch member;

a distal end of said pressing pin pressurely contacts with said cam edge by way of a biasing force of a spring;

said switch member being located on a line extended from an imaginary straight line running between the rotation axis of said rotation member and the aforesaid axis;

a set of plural positive rotation-aimed operation claws and a set of plural reverse rotation-aimed operation claws being provided symmetrically on a distal end surface of the operation piece in such a manner that each set of the positive and reverse rotation-aimed operation claws is positioned such as to be concentric with said ratchet teeth when engaging with said ratchet teeth; and said operation piece being provided, on each of the two lateral sides thereof, with a contact edge which is, when said operation piece receives a load from said ratchet teeth, to pressurely contact with one of pressure receiving edges provided on an inner edge of an accommodation chamber that accommodate said operation piece.

2. A ratchet wrench handle according to claim 1, wherein a mountain-shaped recessed edge is provided on each of said lateral sides of the operation piece thereby to form each of the contact edges, and a mountain-shaped projection edge for correspondingly fitting into one of the mountain-shaped recessed edges is provided on each of corresponding lateral sides of the inner edge of the accommodation chamber thereby to form each of the pressure receiving edges.

* * * * *